United States Patent [19]

Voss et al.

[11] 4,172,420

[45] Oct. 30, 1979

[54] PROPELLANT CHARGE FOR RECOILLESS WEAPONS

[75] Inventors: Alfred Voss, Cologne; Heinz Kroschel, Troisdorf; Manfred Strunk, Neuenrade, all of Fed. Rep. of Germany

[73] Assignee: Dynamit Nobel Aktiengesellschaft, Fed. Rep. of Germany

[21] Appl. No.: 423,086

[22] Filed: Dec. 10, 1973

[30] Foreign Application Priority Data

Dec. 15, 1972 [DE] Fed. Rep. of Germany ..... 2261376

[51] Int. Cl.[2] ..... F41F 3/02

[52] U.S. Cl. ..... 102/38 RL; 89/1.701

[58] Field of Search ..... 102/38, 40, 39, 49.1, 102/49.2, 38 RL; 89/1.7, 1.701, 1.702

[56] References Cited

U.S. PATENT DOCUMENTS

| | | | |
|---|---|---|---|
| 2,156,605 | 5/1939 | Prettyman | 89/1.701 |
| 2,346,124 | 4/1944 | Dew | 89/22 |
| 2,872,864 | 2/1959 | Barnes et al. | 102/49.2 X |
| 3,216,323 | 11/1965 | Wengenroth | 89/1.701 |
| 3,771,417 | 11/1973 | Schonabele et al. | 89/1.702 |
| 3,779,130 | 12/1973 | Schnabele | 89/1.701 |

FOREIGN PATENT DOCUMENTS

| | | | |
|---|---|---|---|
| 1553996 | 4/1970 | Fed. Rep. of Germany | 89/1.701 |

*Primary Examiner*—Harold Tudor
*Attorney, Agent, or Firm*—Craig and Antonelli

[57] ABSTRACT

Propellant charge device for recoilless weapons of the type having a barrel open at both ends with the propellant charge device being positioned behind a projectile and insertable into the front end of the barrel. The propellant charge device includes an elongated casing having a powder charge portion, a cavity portion and a tamp portion axially sequentially arranged within the casing and extending from the front to the rear thereof. The casing has a length such that it extends within the barrel of the weapon from the position thereof behind the projectile substantially over the entire length of the barrel.

21 Claims, 2 Drawing Figures

FIG. 1
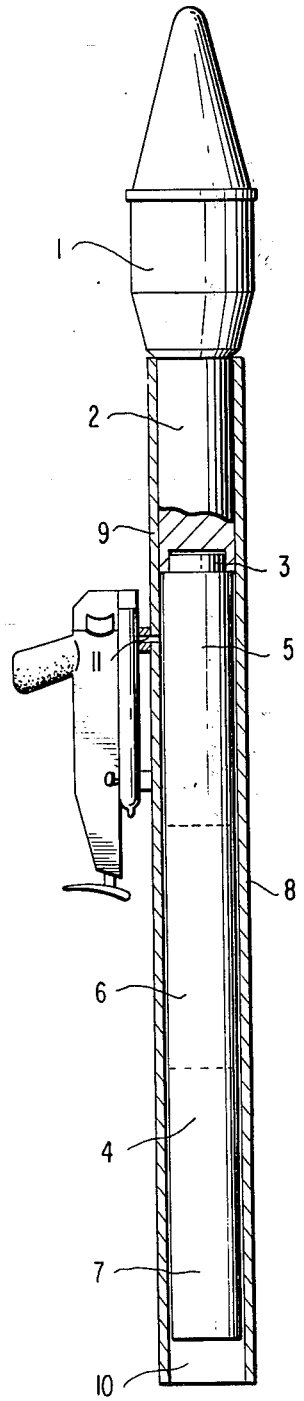
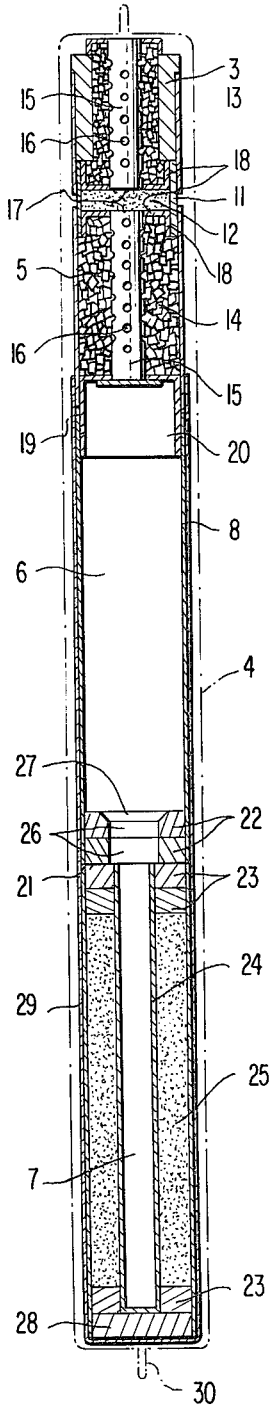
FIG. 2

PROPELLANT CHARGE FOR RECOILLESS WEAPONS

The present invention relates to a propellant charge for recoilless weapons, which charge is disposed behind a projectile insertable from the front into a barrel open on both ends and includes, an axial sequence, a powder portion, a cavity and a tamping composition.

The invention is based on a weapon system wherein a projectile is fired without recoil by means of a propellant charge from a long barrel open at both ends and having a relatively small diameter with the point of ignition—as seen from the muzzle—being approximately at one-third of the length of the barrel. The projectile is generally of the supercaliber type. However, it may also be of equal caliber or even subcaliber.

In such a weapon system, the projectile is pushed into the front end of the barrel of the weapon until a fixed stop has been reached. Between the rear end of the projectile which is still disposed in front of the ignition point for the propellant charge and the end of the barrel, the long free barrel cross-section is available for arranging the propellant charge. The basic structure of the propellant charge is composed of a powder portion with primer charge and one or more charge sections, a tamp or tamping composition which, in most cases is a disintegrating tamping element, and optionally a cavity. Two possibilities are known, in principle, for arranging these components of the propellant charge:

1. Powder portion and tamp being accommodated in a common casing and disposed directly behind the projectile with the tamp directly contacting the powder portion (integral construction).

2. The powder portion being arranged in a casing directly behind the projectile, while the tamp is inserted as a separate part from behind into the rear end of the barrel, so that a free space forming a cavity is provided between the powder portion and the tamp (bipartite construction).

These two charge structures according to the above principles differ from each other regarding their combustion characteristic. In the propellant charge according to (1), a narrow gas pressure—time diagram is obtained which has a uniform course of the curve. In order to attain a maximally high firing velocity of the projectile, the tamp is fashioned to be as heavy as possible, which, however, has the result that the maximally permissible gas pressure for the barrel of the weapon is very quickly attained. Propellant charge systems of this type are known wherein an attempt has been made, by a certain arrangement of the components, to reduce this gas pressure peak and to obtain a flatter and wider gas pressure curve. Thus, a cartridge is disclosed, for example, according to German Patent No. 1,123,953, having two casings, one inserted in the other, the propellant charge powder being arranged between the two casings or in the inner casing. In accordance with DOS (German Unexamined Laid-Open Application) 1,453,826, excessive pressure peaks are decreased by means of an axial passage in the tamping element.

All of these suggestions, however, retain the basic constrution of the propellant charge according to point (1), i.e., the tamp always directly contacts the powder portion. For this reason, only a relatively minor flattening of the gas pressure curve is obtained, and thus also only a minor increase in the firing velocity is the result. A further disadvantage of these integral propellant charges is that they fill the barrel of the weapon only along approximately half its length, i.e., the tamp is disposed relatively closely toward the front such that during firing, the tamp must therefore traverse a relatively long path to the end of the barrel. However, under adverse circumstances, radial vibrations of the barrel may occur which impair the firing accuracy, and additionally because of the friction between the tamp and the inner wall of the barrel, an undesirably high recoil can also occur. Furthermore, in these short, integral propellant charges, inadvertent errors can be made in handling, in that the marksman, for example, after a preceding misfire, fails to remove the propellant charge residues which may be in the barrel, but rather immediately loads the subsequent projectile with a new propellant charge, so that the barrel during firing is expanded or even bursts under unfavorable conditions. The firing safety is thus not sufficiently ensured.

In the bipartite propellant charge according to point (2), these disadvantages are partially avoided. Such a propellant charge is described, for example, in DOS No. 1,553,996. In this system, a certain amount of the propellant charge powder is propelled into the free space between the powder section and the tamp after the primer charge and the charge fragments of the powder portion have been ignited. Thereby, a wider but undesirably wavy or irregular course of the gas pressure curve is obtained, resulting in a certain increase in the efficiency of the propellant charge. However, a basic disadvantage of this solution is also that, when the article is improperly handled, foreign bodies can enter the cavity between the powder portion and the tamping element and can lead to danger to the marksman.

It is therefore an object of the present invention to overcome the above-discussed disadvantages of the conventional propellant charges. That is, to construct a propellant charge for recoilless weapons so that, with simple handling and maximally high firing safety, a substantial increase in the firing speed is made possible.

In accordance with the present invention and starting with the conventional bipartite propellant charge, there is provided for the powder portion, the cavity, and the tamp, a common casing of such a length that it occupies the portion of the barrel of the weapon present behind the projectile at least essentially along its entire length. Thus, the propellant charge is fashioned advantageously as a self-contained system wherein the cavity is an integral component of the remaining elements. Thus, no foreign bodies can enter the cavity and impair the function of the weapon in an undue manner. Any foreign bodies or propellant charge residues possibily still present in the barrel from the preceding firing step are ejected from the barrel during the loading of the propellant charge. The total length of the casing is in each case selected to be large enough that the remaining empty space in the zone of the rear end of the barrel is so small that any possible impurities or clogging material in this space cannot endanger the marksmen. This ensures advantageously that, for example, even if the marksman presses the loaded weapon with its open rear end into sandy soil, which is in actuality not permitted, so that the end of the weapon becomes clogged by a plug of sand, the flawless functioning of the weapon is yet not impaired.

In contrast to the conventional integral and bipartite propellant charges with relatively short casings, the casing of the propellant charge of this invention has a considerable length, so that difficulties were actually expeced during firing in connection with the automatic rearward ejection of the casing from the barrel. For this reason, the general intent has always been to keep the parts of the casing to be ejected as short as possible. However, contrary to expectation, it was found that the relatively long casing of the propellant charge of the present invention is flawlessly ejected to the rear under normal conditions, so that the subsequent round can be loaded without any difficulties. However, the lower the ambient temperatures are when the propellant charge of this invention is employed, the more critical becomes the satisfactory ejection of the casing. In order to ensure flawless functioning even at temperatures as low as at least −40° C., a further feature of the invention provides that the casing is equipped, in the zone of transition from the powder portion to the cavity and from there to the tamp, with respectively one predetermined breaking point extending in the peripheral direction. These predetermined breaking points can be formed, for example, as annular notches. However, it is more advantagous to separate the casing in the zone of the intended predetermined breaking point between the powder portion and the cavity and then rejoin the section, for example, by gluing with an internally inserted, short tubular section. This affords the possibility of testing the powder portion and the tamp-cavity section individually, whereby the manufacturing process is simplified.

In order to facilitate the ejection of the casing from the barrel, it is possible, according to another feature of this invention, additionally or instead of providing the short tubular section, to provide the casing in the zone of the tamp and the cavity on its outer surface with a coating of a friction-reducing material which melts or is vaporized at low temperatures, such as paraffin, wax, or the like.

The powder portion of the propellant charge of the present invention consists conventionally of a charge section on the projectile side and another charge section on the tamp side, with the primer charge being disposed therebetween. In accordance with another feature of this invention, each of the two charge sections has at least one gas conduit starting at the primer charge and extending over the entire length of the charge sections. The propellant charge is arranged betwen the internally empty gas conduit and the outer tube of the charge sections. The gas conduit are provided with perforations on the outer surface in order to facilitate the ignition of the propellant charge powder. By means of the gas conduits according to the present invention, the tamping of the primer charge is reduced in a defined manner; because a portion of the gases produced during the reaction of the primer charge can escape through the gas conduits into the cavity and/or to the projectile arranged in front of the propellant charge. This results in a "gentle" uniform ignition of the propellant powder, so that even at low temperatures of, for example, −40° C., the powder grains, which are correspondingly brittle under these conditions, are not destroyed by the effect of the ignition pressure. This destruction would entail an enlargement of the burning surface and thus an undesirably high rise in gas pressure. The gas conduits furthermore advantageously effect a further smoothing of the wavy or undulating course of the gas pressure curve and thus also a further increase in the firing velocity. The degree of smoothing maximally favorable in each particular case can be determined by the selection of the cross-sectional ratio between the propellant charge casing and the gas conduits.

According to the present invention, for a further defined reduction of the tamping of the primer charge in the zone of the gas conduits, respectively, one cover, which bursts at a low internal excess pressure, can be disposed between the gas conduits and the primer charge. Suitable for this purpose is, for example, a thin paper sheet, aluminum foil, or synthetic resin film, for example, of polyethylene. Optionally, the gas conduits can also be provided on their outer surfaces with a similar thin envelope, if there is the danger that the propellant charge powder grains could penetrate through the perforations in the gas conduits into the conduits proper. In contrast thereto, the primer charge is provided in the zone outside of the gas conduits with a more solid cover, so that the primer charge breaks up after the ignition, initiated radially from the outside, preferably in the region of the gas conduits.

The tamp is suitably provided with a central continuous bore or recess in order to obtain a reduction of the gas pressure peaks in a conventional manner. According to the invention, at least one annular damping disk of a readily deformable material can be arranged at the end of the tamp on the cavity side, so that the impact of the propellant charge powder, which is flung rearwardly during the ignition, is attenuated, to avoid a breaking up of the grains and the gas pressure peaks ensuing therefrom, in turn. These annular disks can consists, for example, of an elastic synthetic resin foam, rubber, "Styropor" which is a foamed polystyrene, felt, or the like. In order to enhance the entrance of the gases into the central recess of the tamp, the at least one annular damping disk can also be provided with a conical inlet and/or a passage opening of larger cross-section than the bore. If this appears advantageous, it is, of course, also possible to dispose such an annular damping disk at the end of the powder portion on the projectile side, in order to maximally brake the movement of the propellant powder grains flung out during the ignition also at that location.

The propellant charge of the present invention ensures, on the one hand, the required safety for the marksman, because errors in handling can no longer be committed and, on the other hand, also yields reproducible results with respect to the gas pressure curve and thus also with respect to the attainable target accuracy even under extreme conditions, i.e., at temperatures of between about −40° C. and +50° C., with the firing velocity being concomitantly increased.

These and further objects, features and advantages of the present invention will become more obvious from the following description when taken in connection with the accompanying drawings which show, for purposes of illustration only, one embodiment in accordance with the present invention; and wherein FIG. 1 is a partial sectional view of a loaded weapon in accordance with the present invention; and FIG. 2 is a longitudinal sectional view of an embodiment of the propellant charge in accordance with the present invention.

Referring now to the drawing wherein like reference numerals are utilized to designate like parts throughout the several views, there is shown in FIG. 1, a projectile 1 connected with a propellant charge 4 via a projectile stem 2 and a coupling 3, not shown in detail, which functions, for example, in the manner of a bayonet connection. The propellant charge 4 is provided in axial succession with a powder portion 5, a cavity 6, and a tamp 7, disposed within the common casing 8. The projectile 1 and the propellant charge 4 are introduced together into the barrel 9 of the weapon from the front end of the barrel, shown in a longitudinal sectional view, and fill the barrel except for the small space 10 at the rear end thereof. The ignition of the powder portion 5 is initiated from the outside via members 11 of the weapon and projectile.

FIG. 2 shows the propellant charge 4 on an enlarged scale with respect to the scale of FIG. 1. The charge includes the casing 8, surrounding the powder portion 5, the cavity 6, and the tamp 7. The casing 8 can be made of metal, synthetic resin, cellulose fibers, such as cardboard, for example, etc. The powder portion 5 is subdivided by the primer charge 12 into a charge section 13 on the side of the projectile and the charge section 14 on the side of the tamp. In both charge sections, gas conduits 15 are arranged, having the perforations 16 and the covers 17, the covers 17 being arranged to burst at low inner excess pressure. Outside of the gas conduits 15, the primer charge 12 is provided with the more solid covers 18 of cardboard, for example. At their ends facing away from the primer charge 12, the gas conduits 15 can optionally be furthermore equipped with a rather thin lid of paper, synthetic resin film, or the like, preventing the penetration of impurities, moisture, or the like, but readily rupturing under the pressure of the propellant gases, so that the discharge of the gases is practically not impeded at all. The gas conduits 15 can be produced, for example, of cardboard or a synthetic resin. The coupling 3, not illustrated in detail, serves for connecting the propellant charge with the projectile 1. At 11, the radial ignition is initiated from the outside. The casing 8 is divided behind the powder portion 5, in order to form the predetermined breaking zone 19, and is joined again with the glued-in internal sleeve or tube 20. At the transition from the cavity 6 to the tamp 7, the predetermined breaking zone 21, formed as an annular notch, is arranged within the casing 8. The predetermined breaking zone 21 is disposed so that it is located between the damping disks 22 arranged at the front end of the tamp 7, and centering rings 23. This has the advantageous result that, after the tamp 7 has been separated at the predetermined breaking zone 21 under the effect of the propellant gases, the damping disks 22 glued to the casing 8 are effective as thrust surfaces for the propellant gases and thus enhance the ejection of the remaining fragments of the casing toward the rear from the barrel 9 of the weapon.

The tamp 7 has a central inner tube 24 formed of cardboard, a synthetic resin, or the like and positioned at both of its ends by means of centering rings 23. The tamping powder 25, for example poured iron powder, is arranged between the casing 8 and the inner tube 24. At the end of the tamp 7 on the cavity side, the two annular damping disks 22 are provided and have a passage or bore 26 and a conical inlet 27. At the other end of the tamp 7, a sealing disk 28, made of cardboard, a synthetic resin, or the like, is disposed. The casing 8 has a coating 29 of wax, paraffin, or the like in the zone of the tamp 7 and the cavity 6. In its entirety, the casing 8 is housed in a thin-sheet tube 30 provided with a drawstring, for protection during storage and transportation. The materials of all individual components of the propellant charge of this invention are selected, as is conventional, so that they fulfill their function in the propellant charge 4, on the one hand, but do not cause an undesirably large danger zone behind the weapon during firing with respect to the parts ejected therefrom toward the rear, on the other hand.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims:

What we claim is:

1. Propellant charge device for recoilless weapons of the type having a barrel open on both ends, the propellant charge device being arranged for disposition behind a projectile insertable in the front portion of the barrel, the propellant charge device comprising an elongated common casing means containing in axial sequential position therein from the front to the rear thereof, powder charge means a cavity, and a tamp means, the powder charge means and the tamp means delimiting the cavity within the common casing means, the common casing means having a length such that it extends from the position thereof within the barrel behind the projectile along substantially the entire length of the barrel, the casing means being constructed for being driven out of the barrel in response to propellant gases generated when firing the projectile, the powder charge means including first and second powder charge portions within the casing extending in the axial direction thereof and a primer charge portion disposed betwen the first and second powder charge positions such that the first powder charge portion is disposed proximate to the front end of the casing means and the second powder charge portion is disposed proximate to the cavity, each of the powder charge portions including at least one gas conduit extending from the primer charge over the entire length of the powder charge portion.

2. Propellant charge device according to claim 1, wherein the casing means is provided with at least one predetermined breaking means in the region of the transition of the powder charge means and the cavity and in the region of the transistion of the cavity and the tamp means, the predetermined breaking means extending about the periphery of the casing means.

3. Propellant charge device according to claim 2, wherein at least one predetermined breaking means is an annular notch provided in the periphery of the casing means.

4. Propellant charge device according to claim 1, including friction reducing means disposed on the casing means in the region of the tamp means and the cavity.

5. Propellant charge device according to claim 4, wherein the friction reducing means is a coating of a friction reducing material which at least one of melts and vaporizes at low temperature.

6. Propellant charge device according to claim 5, wherein the friction reducing material is one of paraffin and wax.

7. Propellant charge device according to claim 4, wherein the friction reducing means is disposed on the casing only in the region of the tamp means and the cavity.

8. Propellant charge device according to claim 1, wherein each of the gas conduits are provided with perforations extending over the length thereof.

9. Propellant charge device according to claim 1, further comprising a cover member for each of the conduits, the cover member being disposed between the gas conduit and the primer charge and being arranged to burst at a low inner excess pressure.

10. Propellant charge device according to claim 1, wherein each gas conduit is hollow, unfilled, tubular member.

11. Propellant charge device according to claim 1, wherein the primer charge has an outer cross sectional dimension corresponding to the outer cross sectional dimension of the first and second powder charge portions adjacent thereto, and the at least one conduit has an cross sectional dimensions substantially smaller than the outer cross sectional dimensions of the primer charge and powder charge portions.

12. Propellant charge device according to claim 1, wherein the casing means is provided with breaking means so that the casing breaks into sections and the sections are driven out of the barrel by propellant gasses during firing of the projectile, the casing means having a substantially uniform outer cross sectional dimension over the entire length thereof.

13. Propellant charge device according to claim 1, wherein the cavity is delimited only by the tamp means, the powder charge means and the casing means.

14. Propellant charge device according to claim 1, wherein opposing faces of the tamp means and powder charge means delimite the cavity within the casing means.

15. Propellant charge device according to claim 1, wherein the tamp means include means providing a central elongated continuous bore therethrough and at least one annular damping disk member formed of a readily deformable material being provided at the end of the tamp means adjacent the cavity.

16. Propellant charge device according to claim 15, wherein the means forming the bore is a tubular member and the tamp means further comprises powdered tamp material disposed betwen the tubular member and the casing means.

17. Propellant charge device according to claim 16, wherein the tamp means includes a sealing disk disposed at the rear end of the casing means.

18. Propellant charge device according to claim 1, wherein the casing means is a cylindrical member formed in at least two sections and including an internal sleeve member positioned at the junction of the at least two sections.

19. Propellant charge device according to claim 1, wherein the barrel of the recoilless weapon is of the reuseable type and said elongated common casing has substantially the same outer cross sectional dimensions over the entire length thereof which corresponds to the interior cross sectional dimensions of the barrel.

20. Propellant charge device for recoilless weapons of the type having a barrel open on both ends, the propellant charge device being arranged for disposition behind a projectile insertable in the front portion of the barrel, the propellant charge device comprising an elongated common casing means containing in axial sequential position therein from the front to the rear thereof, powder charge means, a cavity, and a tamp means, the powder charge means and the tamp means delimiting the cavity within the common casing means, the common casing means having a length such that it extends from the position thereof within the barrel behind the projectile along substantially the entire length of the barrel, the casing means being constructed for being driven out of the barrel in response to propellant gases generated when firing the projectile, the tamp means including means for providing a central elongated continuous bore therethrough and at least one annular damping disk member formed of a readily deformable material being provided at the end of the tamp means adjacent the cavity.

21. Propellant charge device according to claim 20, wherein the powder charge means includes first and second powder charge portions within the casing extending in the axial direction thereof and a primer charge portion disposed between the first and second powder charge portions such that the first powder charge portion is disposed proximate to the front end of the casing means and the second powder charge portion is disposed proximate to the cavity.

* * * * *